US009364738B2

(12) United States Patent
Kim

(10) Patent No.: US 9,364,738 B2
(45) Date of Patent: Jun. 14, 2016

(54) RECREATIONAL BOARD RISER

(71) Applicant: Henry Kim, Toronto (CA)

(72) Inventor: Henry Kim, Toronto (CA)

(73) Assignee: Henry Kim, Toronto (CA)

( * ) Notice: Subject to any disclaimer, the term of this patent is extended or adjusted under 35 U.S.C. 154(b) by 267 days.

(21) Appl. No.: 14/103,185
(22) Filed: Dec. 11, 2013

(65) Prior Publication Data

US 2015/0108727 A1 Apr. 23, 2015

Related U.S. Application Data

(60) Provisional application No. 61/893,482, filed on Oct. 21, 2013.

(51) Int. Cl.

| | |
|---|---|
| ***A63C 10/14*** | (2012.01) |
| ***A63C 10/16*** | (2012.01) |
| ***A63C 10/18*** | (2012.01) |
| ***A63C 10/26*** | (2012.01) |
| *A63C 10/04* | (2012.01) |
| *A63C 10/20* | (2012.01) |

(52) U.S. Cl.
CPC ..... *A63C 10/14* (2013.01); *A63C 10/18* (2013.01); *A63C 10/26* (2013.01); *A63C 10/04* (2013.01); *A63C 10/20* (2013.01)

(58) Field of Classification Search
CPC ..... A63C 10/00; A63C 10/14; A63C 10/145; A63C 10/20; A63C 10/26; A63C 10/28; A63C 10/285
USPC ..... 280/617, 636, 618, 633, 87.042, 87.041
See application file for complete search history.

(56) References Cited

U.S. PATENT DOCUMENTS 4,937,955 A * 7/1990 Bonaventure ..... A43B 5/0417 280/613
5,026,086 A 6/1991 Guers et al.
5,127,672 A * 7/1992 Horibata ..... A63C 11/22 280/11.14
5,263,725 A * 11/1993 Gesmer ..... A63C 17/0093 280/11.28
5,474,321 A 12/1995 Pritz
5,580,077 A * 12/1996 Dodge ..... A63C 5/03 280/14.22
5,671,939 A * 9/1997 Pineau ..... A63C 9/003 280/602
5,765,854 A 6/1998 Moore et al.
5,813,688 A * 9/1998 Dacklin ..... A63C 10/08 280/14.22
5,868,408 A * 2/1999 Miller ..... A63C 17/0046 280/11.28
5,895,068 A 4/1999 Doyle
5,947,508 A * 9/1999 Graf ..... A63C 10/08 280/613
6,007,085 A * 12/1999 Rigal ..... A63C 10/20 280/14.24
6,102,428 A * 8/2000 Bobrowicz ..... A63C 5/003 280/607
6,318,739 B1 * 11/2001 Fehn, Jr. ..... A63C 17/0046 280/11.223
6,412,793 B2 7/2002 de France
6,505,841 B1 * 1/2003 Kessler ..... A63C 10/14 280/14.21
6,655,700 B1 * 12/2003 Caputo ..... A63C 10/10 280/11.3

(Continued)

*Primary Examiner* — Joseph Rocca
*Assistant Examiner* — Travis Coolman
(74) *Attorney, Agent, or Firm* — Rankin, Hill & Clark LLP

(57) ABSTRACT

A riser for mounting to a rider-support surface of a recreational board and having a binding connected thereto comprises a first plate and a second plate selectively connectable to the first plate along a length of the first plate so as to define a connection location. A plurality of separate and interchangeable dampening members is connectable to each of the first plate and second plate. The plurality of dampening members is spaced along a portion of each first and second plate which is opposite the connection location of the first and second plates. The plurality of dampening members includes a first dampening member and a second dampening member, each having a differing hardness.

17 Claims, 8 Drawing Sheets

(56) References Cited

U.S. PATENT DOCUMENTS 6,659,493 B1 * 12/2003 Trnka ..... A63C 5/075 280/11.14
7,063,346 B2 * 6/2006 Elkington ..... A63C 10/14 280/11.3
7,134,928 B1 * 11/2006 Cannon ..... A63C 10/04 280/608
7,341,271 B2 * 3/2008 Bunter ..... A63C 5/04 280/602
8,297,630 B2 * 10/2012 O'Rourke ..... A63C 17/0033 280/87.042
8,801,025 B2 * 8/2014 Mars ..... A63C 1/22 280/607
9,022,412 B2 * 5/2015 Ritter ..... A63C 5/02 280/14.26
2001/0002083 A1 * 5/2001 de France ..... A43B 5/0401 280/607
2002/0024187 A1 * 2/2002 Gyr ..... A43B 13/141 280/14.22
2002/0113384 A1 * 8/2002 Kasai ..... A63C 10/14 280/14.21
2003/0107199 A1 * 6/2003 DeSchinkel ..... A63C 17/01 280/87.042
2003/0116931 A1 * 6/2003 Quattro ..... A63C 5/128 280/14.21
2003/0155733 A1 * 8/2003 Tan ..... A63C 17/01 280/87.042
2004/0061300 A1 * 4/2004 Grossman ..... A63C 17/0046 280/87.042
2004/0145155 A1 * 7/2004 Martin ..... A63C 10/14 280/618
2004/0201202 A1 * 10/2004 Sato ..... A63C 10/14 280/617
2005/0253347 A1 * 11/2005 Martin ..... A63C 10/14 280/14.22
2006/0175802 A1 * 8/2006 Maravetz ..... A63C 10/04 280/619
2007/0108734 A1 * 5/2007 Korich ..... A63C 9/001 280/607
2007/0290463 A1 * 12/2007 White ..... A63C 10/18 280/14.24
2009/0206564 A1 * 8/2009 Lin ..... A63C 5/03 280/14.22
2009/0230658 A1 * 9/2009 Fournier ..... A63C 5/003 280/607
2009/0295111 A1 * 12/2009 O'Rourke ..... A63C 17/0033 280/86.751
2013/0113184 A1 * 5/2013 Pelchat ..... A63C 10/16 280/607
2014/0252748 A1 * 9/2014 Fournier ..... A63C 10/16 280/607
2015/0001817 A1 * 1/2015 Imbrie ..... A63C 17/015 280/11.27

* cited by examiner

RECREATIONAL BOARD RISER

This application claims priority to U.S. Provisional Patent Application Ser. No. 61/893,482 filed on Oct. 21, 2013, the disclosure of which is incorporated herein in its entirety by reference.

BACKGROUND

The present disclosure generally relates to the area of sports such as skiing and snowboarding, and more particularly, relates to a riser or riser plate for a recreational board. The concept of a riser for spacing a binding from a rider-support surface of a recreational board, such as a snowboard, for example, is not new to snowboarding. The riser is mounted directly to the upper surface of the snowboard via a pre-placed mounting hole pattern in the snowboard and the binding is secured to the riser. However, typical risers are simple plastic disks designed to solve the problem of a rider's toes or heel dragging in the snow when the snowboard is tipped on edge. When a rider's foot is elevated off the surface of the snowboard, the likelihood of boot drag is reduced. It is also known to employ shock absorbers to improve the comfort of the snowboarder. Without shock absorbers, irregularities in the slopes can subject the snowboard to shocks and vibrations which are transmitted directly to the snowboarder. This can cause discomfort and fatigue which can lead to accidents.

BRIEF DESCRIPTION

In accordance with one aspect, a riser for mounting to a rider-support surface of a recreational board and having a binding connected thereto comprises a first plate and a second plate selectively connectable to the first plate along a length of the first plate so as to define a connection location. A plurality of separate and interchangeable dampening members is connectable to each of the first plate and second plate. The plurality of dampening members is spaced along a portion of each first and second plate which is opposite the connection location of the first and second plates. The plurality of dampening members includes a first dampening member and a second dampening member, each having a differing hardness.

In accordance with another aspect, a riser for mounting to a rider-support surface of a recreational board and having a binding connected thereto comprises a first plate and a second plate selectively connectable to the first plate. At least one of the first and second plates includes a plurality of installation holes defining at least one installation pattern corresponding to a mounting hole pattern provided on the rider-support surface of the recreational board. A connecting element is configured to connect the first plate to the second plate and mount the riser to the to the rider-support surface of the recreational board. The connecting element includes a body having at least two spaced apertures selectively aligned with at least two installation holes allowing for movement in two directions of the first plate relative to the second plate and allowing the first and second plates to be connectable in an offset matter. A plurality of separate and interchangeable dampening members is connectable to each of the first plate and second plate. The plurality of dampening members includes a first dampening member, a second dampening member, and a third dampening member, each having a differing hardness.

In accordance with yet another aspect, a riser for mounting to a rider-support surface of a recreational board and having a binding connected thereto comprises a plurality of interchangeable disk-shaped dampening members directly engaging a rider-support surface of a recreational board and spaced from a binding. The plurality of dampening members is aligned along a length of the riser and includes a first dampening member, a second dampening member, and a third dampening member. Each dampening member has a differing hardness. The plurality of dampening members has durometers ranging from 60 A to 100 A.

DETAILED DESCRIPTION

The description and drawings herein are merely illustrative and various modifications and changes can be made in the structures disclosed without departing from the scope of the present disclosure. It will be appreciated that the various identified components of the exemplary recreational board riser disclosed herein are merely terms of art that may vary from one manufacturer to another and should not be deemed to limit the present disclosure.

Figure 1:
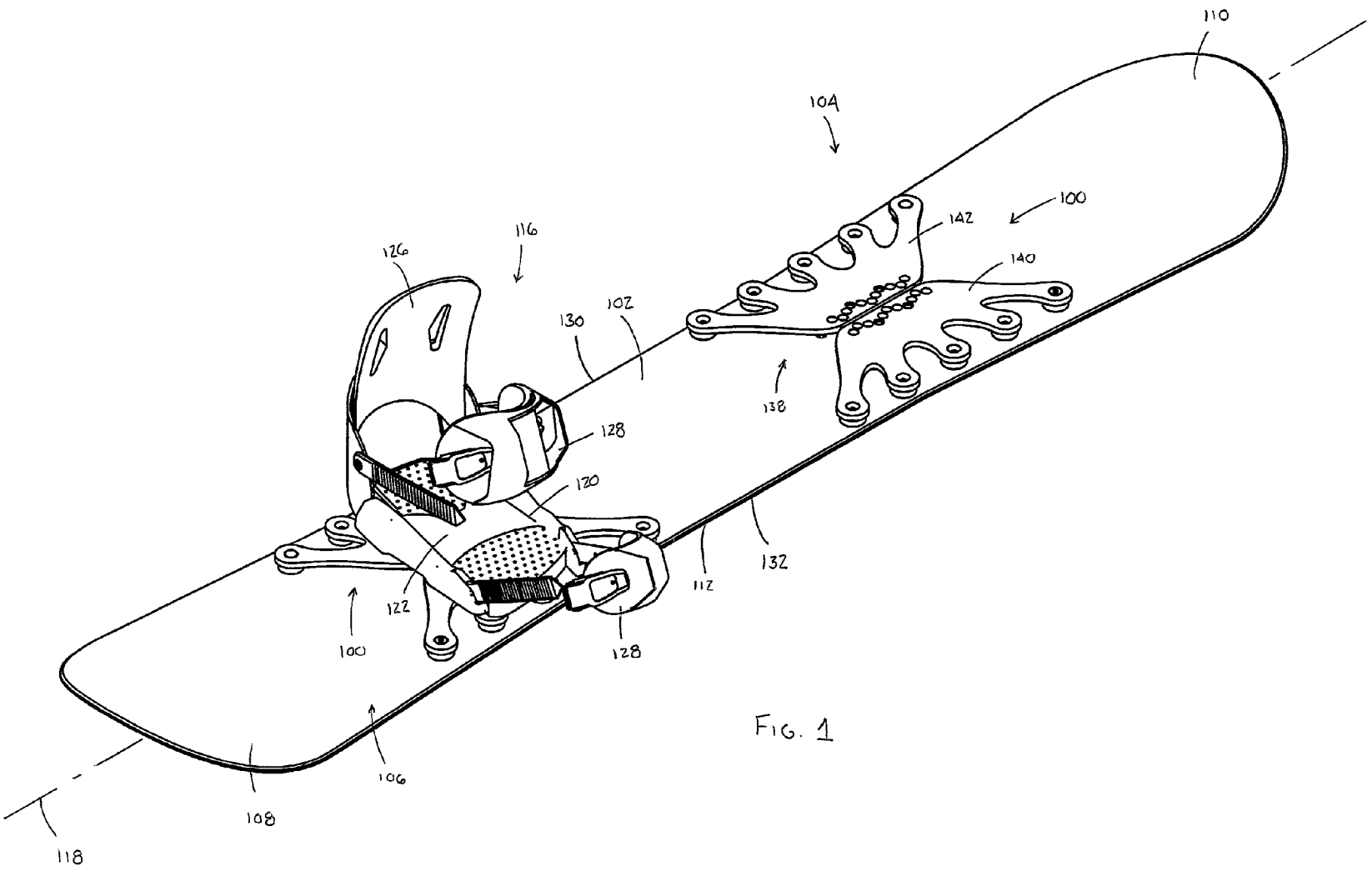
FIG. 1 is a perspective view of risers according to one aspect of the present disclosure for mounting to a rider-support surface of a recreational board and having a binding connected to one riser.

Referring now to the drawings, wherein like numerals refer to like parts throughout the several views, FIG. 1 illustrates a pair of exemplary risers 100 according to one aspect of the present disclosure mounted to a rider-support surface 102 of a recreational board 104. The recreational board 104 may be a snowboard or some other type of recreational board. The recreational board 104 has a relatively flat elongated body 106 with upwardly curving front 108 and rear 110 opposing ends. A bottom surface 112 of the recreational board 104 is prepared for gliding on snow-covered surfaces, while the top rider-support surface 102 is prepared for attaching front and rear bindings (only the front binding 116 attached to the riser 100 closest to the front end 108 is depicted). Those skilled in the art will appreciate that the rear binding may be generally similar to front binding 116. The recreational board 104 is generally designed to be ridden in directions aligned with its longitudinal axis 118 such that one of the rider's feet (and a corresponding one of the bindings) leads the other foot (and the other binding) in the direction of motion.

The front binding 116 includes a base 120, which is rigidly mounted atop the riser 100, having a foot-receiving surface 122 for receiving the rider's foot. A foot-retainer 126 having straps 128 retains the rider's foot in generally fixed relation thereto such that the rider's foot (or footwear) is retained atop foot-receiving surface 122 with the rider's toes retained on one transverse side of the longitudinal axis of the recreational board 104 and the rider's heel retained on the opposing transverse side of the longitudinal axis 118. The transverse edge of recreational board 104 closest to the rider's heel may be referred to as a heel edge 130 of the recreational board 104 and the transverse edge of the recreational board 104 closest to the rider's toes may be referred to as toe edge 132 of the recreational board 104. In the FIG. 1 configuration, the rider's left foot is leading their right foot such that heel edge 130 is on the left side of the illustrated view and toe edge 132 is on the right side of the illustrated view.

Figures 2, 3:
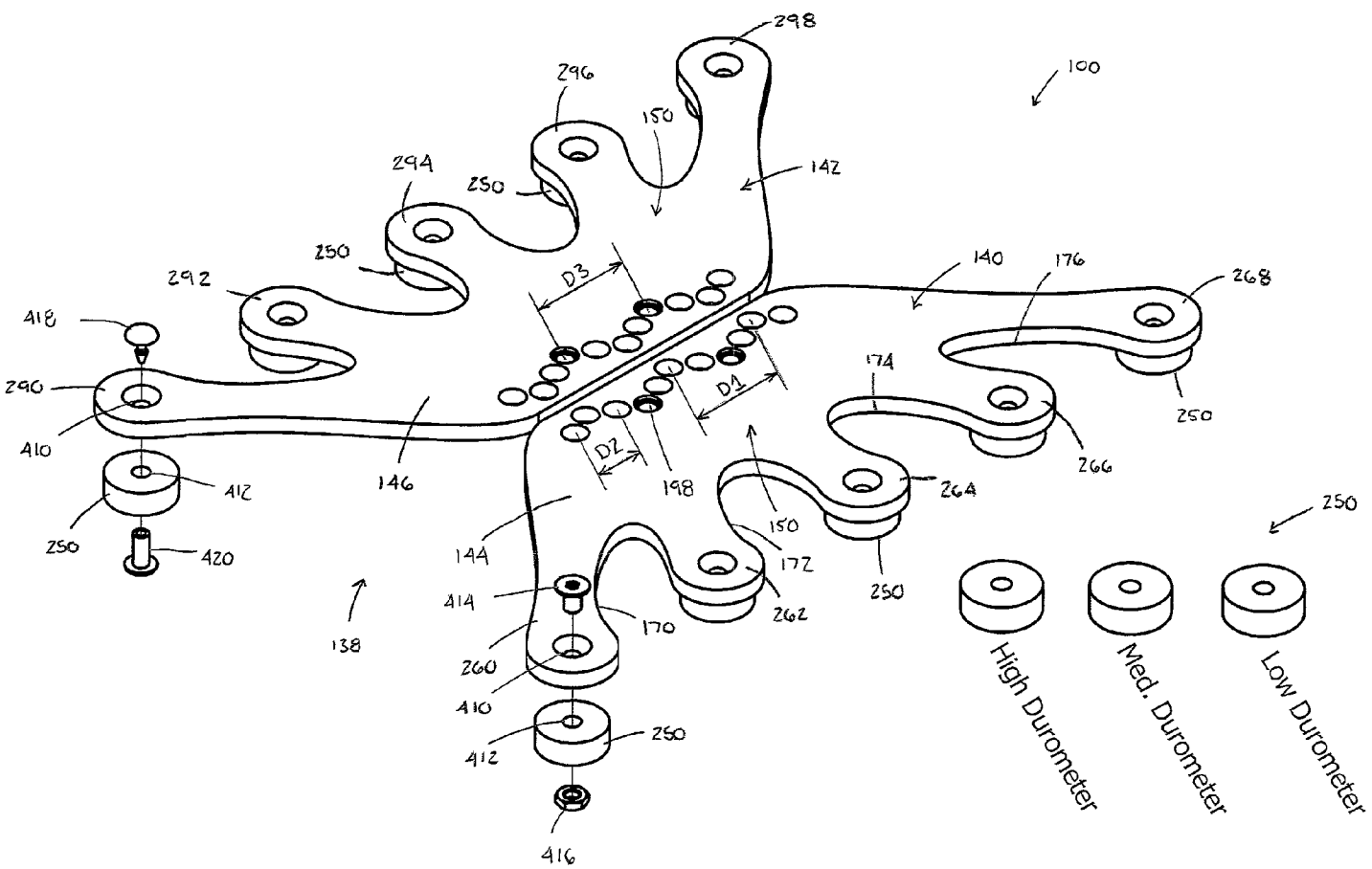
FIG. 2 is a partially exploded perspective view of one riser of FIG. 1, the riser including a first plate connected to a second plate and a plurality of dampening members connected to the first and second plates.
FIG. 3 is a perspective view of the plurality of dampening members of FIG. 2.
Figure 4:
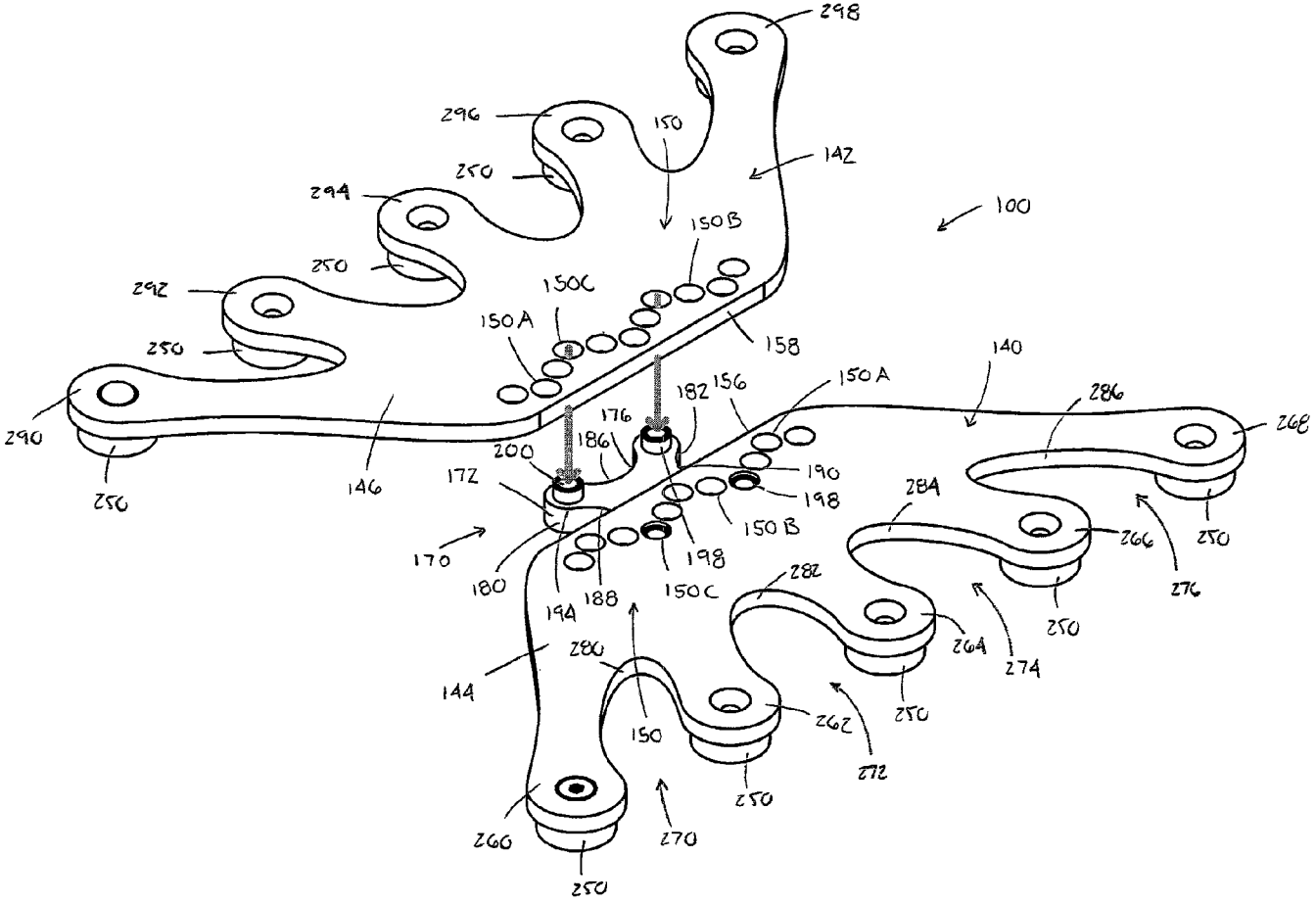
FIG. 4 is a partially exploded perspective view of the riser of FIG. 2 depicting a connecting element according to one aspect of the present disclosure configured to connect the first plate to the second plate.

With reference to FIGS. 2-4, each riser 100 generally includes a plate 138 with user interchangeable dampening properties which is mounted directly to the rider-support surface 102 of the recreational board 104. More particularly, the plate 138 of each exemplary riser 100 can be defined by a first plate 140 and a second plate 142 selectively connectable to the first plate 140 along a length of the first plate so as to define a connection location.

As is well known, a first group of binding mounting holes (not shown) are generally positioned towards the front end 108 of the recreational board 104, defining a front mounting location for the front binding 116, and a second group of binding mounting holes (not shown) are positioned toward the rear end 110 of the recreational board 104, defining a rear mounting location for the rear binding (not shown). Each group of binding mounting holes typically is a defined pattern of threaded holes (e.g., a 4×4 pattern of threaded holes) for receiving threaded fasteners which are used to attach the front bindings 116 and rear binding to the recreational board 104. To allow the use of a particular binding on a variety of recreational boards, the plate 138 of each riser 100 has a width (in a direction perpendicular to the axis 118) sufficient to mount the binding. The riser plate 138 includes installation holes 150 defining at least one installation hole pattern corresponding to the typical mounting hole pattern of commercially available recreational boards 104 to which the plate 138 of the exemplary riser 100 is to be attached. Releasable fasteners, such as threaded screws, are inserted through certain of the installation holes 150 of the plate 138 and into the mounting holes on the recreational board 104 to releasably secure the riser thereto. The desired binding can then be mounted to the riser in the position desired by the rider also by use of the installation holes 150. It should be appreciated that the installation holes 150 can have counter bores which allows the fasteners to seat below a top surface of the riser 100 to prevent interference between the riser 100 and the base of the binding when the binding is mounted thereto.

Each first plate 140 includes a body 144 and each second plate 142 includes a body 146. At least one of the body 144 of the first plate 140 and the body 146 of the second plate 142 has the installation holes 150 which as indicated above define at least one installation hole pattern corresponding to the mounting hole pattern (not shown) provided on the rider-support surface 102 of the recreational board 104. In the depicted embodiment, each of the bodies 144, 146 of the respective first and second plates 140, 142 of each riser 100 includes the installation holes 150. The installation holes 150 allow each of the first plate 140 and second plates 142 to be mounted in various positions longitudinally on the rider-support surface 102 and allow the riser 100 to accommodate various board widths. The installation holes of each plate 140, 142 can be grouped into a first group 150A of installation holes that are positioned adjacent (and nearest) a connecting edge 156 of the body 144 and a connecting edge 158 of the body 146, a second group 150B of installation holes offset inwardly from the first group 150A away from the connecting edges 156, 158, and a third group 150C offset inwardly from the second group 150B further away from the connecting edges 156, 158. Each group is arranged within the riser 100 such that through holes 150 are linearly aligned with each other within a group and the groups are aligned with each other along three parallel lines of one group of installation holes each.

Figure 8:
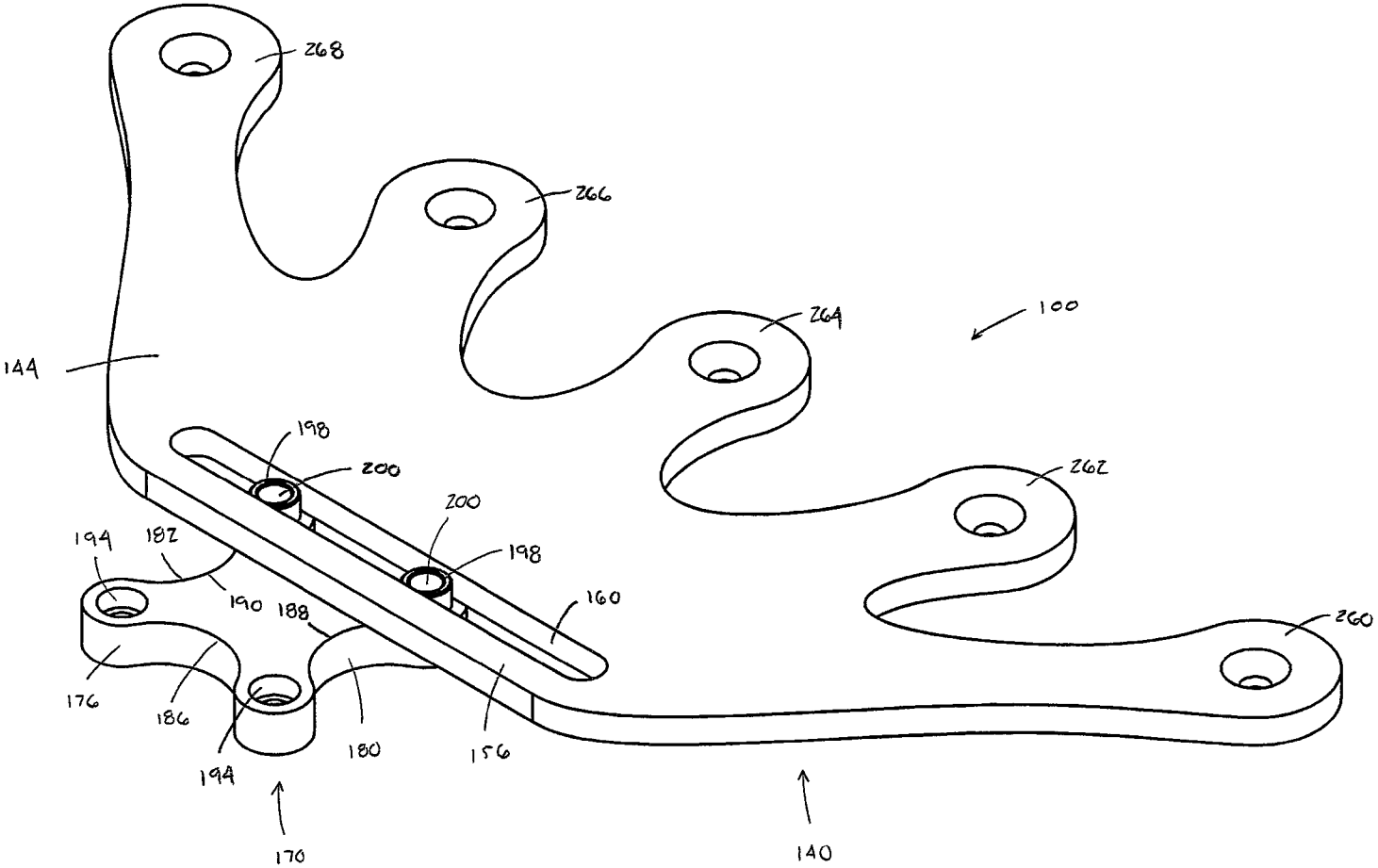
FIG. 8 is a perspective view of an alternative plate similar to the plate shown in FIG. 4.

As illustrated, the first group 150A provided on each body 144, 146 can be defined by three equally spaced installation holes 150 with a spacing between the installation holes of the first group 150A defining a first distance D1. The second group 150B provided on each body 144, 146 can be defined by six equally spaced installation holes 150 with a spacing between the installation holes of the second group 150B defining a second distance D2. According to one aspect, the second distance is equal to one-half of the first distance D1. The third group 150C provided on each body 144, 146 can be defined by two spaced installation holes 150 with spacing between the installation holes of the third group 150C defining a third distance D3. In the depicted embodiment, the third distance is equal to the first distance D1. It should be appreciated that the number of installation holes provided in each group, the spacing between installations holes in each group and the number of groups provided on each plate 140, 142 are by way of example only, and that alternative layouts of the installations holes 150 for each plate 140, 142 are contemplated. Further, it should be appreciated that certain of the installation holes 150 of each group can be elongated in shape. Still further, instead of the installation holes 150, for example, of the first group 150A of the first plate 140, an elongated slot 160 can extend through the body 144. As shown in FIG. 8, the slot 160 can extend substantially the entire length of the connecting edge portion 156 of the first plate 140. Although only one elongated slot is depicted, one skilled in the art would appreciated that three spaced elongated slots can be located on the body 144, one slot for each group of installation holes and/or the elongated slot 160 can be used with selected groups of installation holes. As will be described below, the arrangement of the installation holes 150 (and/or slots 160) provided on each of the first plate 140 and second plate 142 allows the first and second plates to be independently positioned on the rider-support surface 102 of the recreational board, thereby allowing for installation of the first and second plates 140, 142 of each riser 100 in an asymmetrically layout (see FIGS. 5 and 6). This also permits a wide range of adjustment of the binding mounted atop each riser 100.

Each of the first plate 140 and second plate 142 of the exemplary riser 100 is formed of a material, or a combination of materials, such as metal, plastic, and a composite material (e.g., a carbon fiber material), which has/have a sufficient strength to maintain structural integrity of the riser 100 in light of stresses generated by the user when skiing on the recreational board 104, the various mounting structures formed in each plate, as well as the necessary resistance to snow, water, ice, and other weather related factors to which each riser 100 (and binding 116 connected thereto) is exposed during use.

Figure 6:
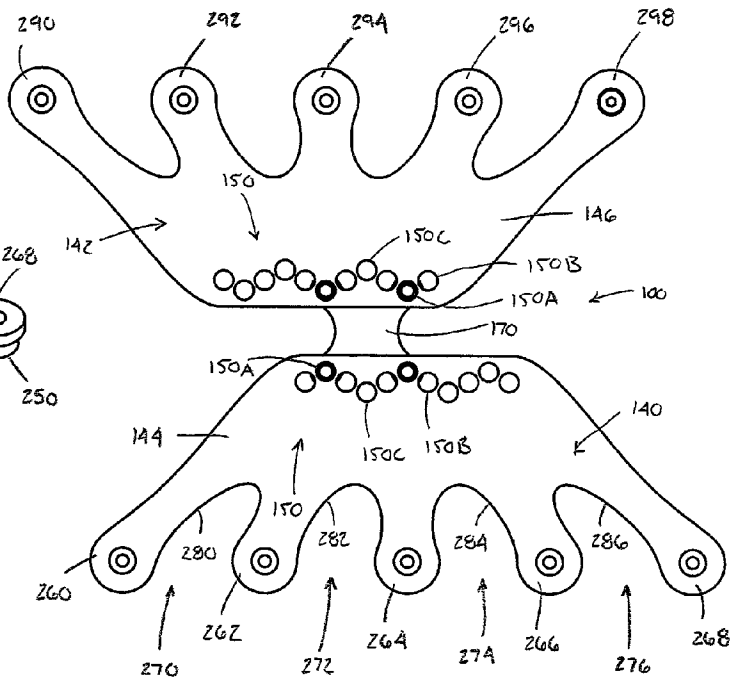
FIG. 6 is a top plan view of FIG. 5.
Figure 5:
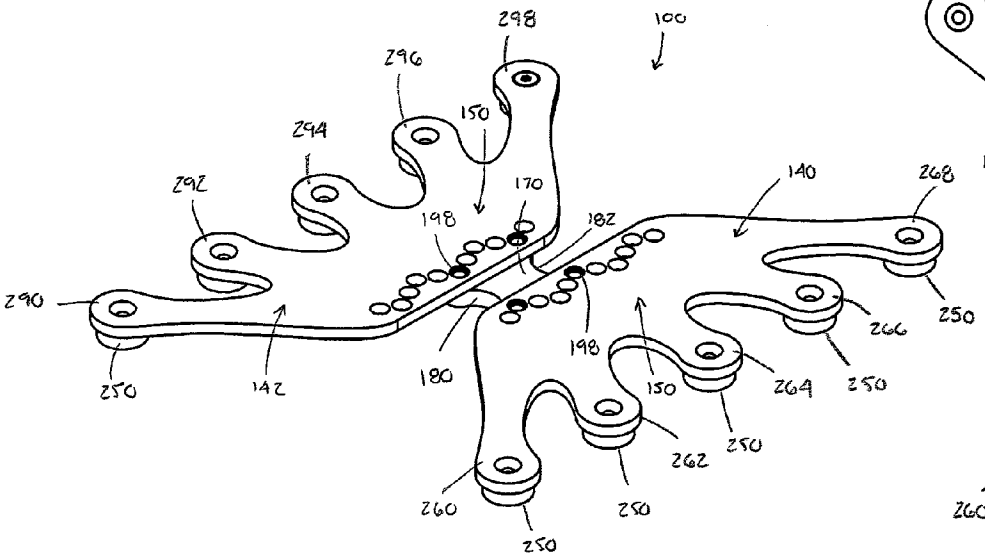
FIG. 5 is a perspective view of the first and second plates of the riser of FIG. 4 being connected in an offset manner.

To facilitate the connection of each riser 100 to the rider-support surface 102 of the recreational board, a separate connecting element 170 is provided. The connecting element 170 connects the first plate 140 to the second plate 142 and mounts the riser 100 to the rider-support surface 102. According to one aspect, as shown in FIGS. 4-6, the connecting element 170 includes a body 172 having opposite sidewalls (only sidewall 176 is visible), and opposite end walls 180, 182. Each of the sidewalls includes a recessed portion (e.g., recessed portion 186 of sidewall 176) and each of the end walls 180, 182 includes a recessed portion 188, 190. In the illustrated embodiment, each of the recessed portions can be centrally located on the respective sidewalls and end walls. The body 172 of the connecting element 170 also has at least two spaced apertures 194 extending through the body to be selectively aligned with at least two installation holes 150 of each first and second plate 140, 142 allowing the connecting element to be mounted to the first and second plates 140, 142 and the rider-support surface 102 of the recreational board 104. As shown, one aperture 194 is located at each corner portion of the body 172, and a spacing or distance between the apertures 194 along each sidewall is equal to the distance D1. The body 172 can further include at least two outwardly (upwardly) extending bosses 198 having openings 200 extending therethrough communicating with the apertures 194. The bosses 198 are dimensioned to be positioned in the installations holes 150 of at least one of the first and second plates 140, 142. In the depicted embodiment, four bosses 198 are provided, one for each aperture 194. The bosses 198 can be separate from the body 172. The body 172 can be made from various types of elastomeric materials, foam, rubber, suitable plastics, suitable polymeric materials and/or the like.

To mount the connecting element 170 to the first and second plates 140, 142, the bosses 198 along one sidewall are positioned in two installation holes 150 of one of the groups 150A, 150B, 150C of the first plate 140 and the bosses 198 along the other sidewall 176 are positioned in two installation holes 150 of one of the groups 150A, 150B, 150C of the second plate 142. More particularly, according to one aspect, a spacing or distance between apertures 194 along each end wall 180, 182 is equal to a distance between the installations holes 150 of the third group 150C of the first plate 140 and the installation holes 150 of the third group 150C of the second plate 142 in the assembled condition of the riser 100 shown in FIG. 2. This distance allows for an adjustable spacing between the first and second plates 140, 142. For example, to increase the width of the riser 100, the bosses 198 along each sidewall of the body 172 can be selectively moved from the installation holes 150 of the third group 150C of each first and second plate 140, 142 to the installation holes 150 of the first group 150A of each first and second plate 140, 142 (see FIGS. 5 and 6). Further, with the distance between the apertures 194 along each sidewall being equal to the distance D1, the first and second plates can be mounted to the connecting element 170 in an offset manner. Thus, it should be appreciated that the connecting element 170 allows for movement in two directions of the first plate 140 relative to the second plate 142 and allows the first and second plates to be connectable in an offset manner (and mounted to the rider-support surface 102 of the recreational board 104 an offset matter). For example, by using a different combination of installation holes, the riser 100 can be made to fit recreational boards of different width. Because each of the first and second plates 140, 142 can be independently positioned, the rider can install the plates in an asymmetrical layout. For example, the rider may prefer the toe side plate to be more forward of the heel side plate.

Figure 7:
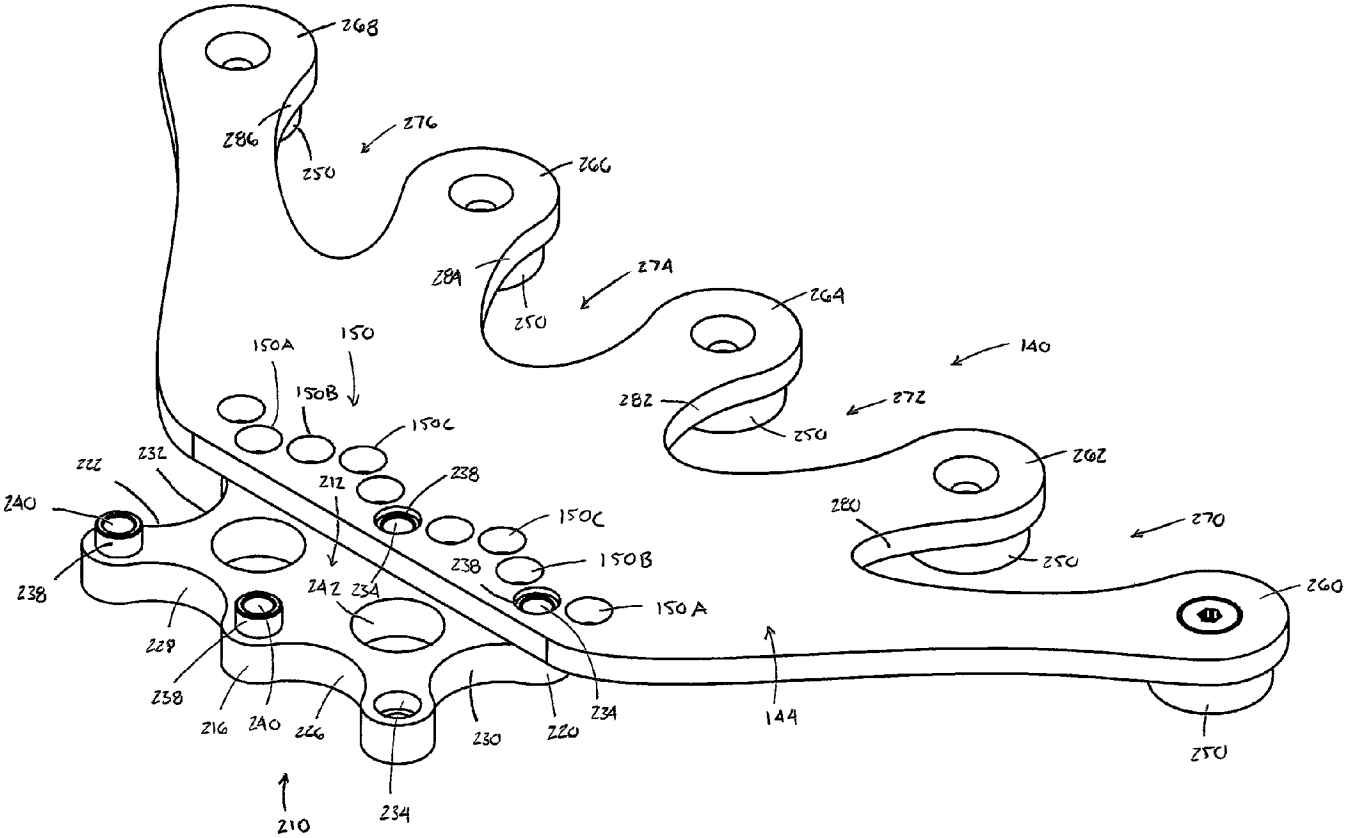
FIG. 7 is a partial perspective view of the riser of FIG. 4 depicting an alternative connecting element according to another aspect of the present disclosure.

FIG. 7 depicts an alternative embodiment of a connecting element 210 including a body 212 having opposite sidewalls (only sidewall 216 is visible), and opposite end walls 220, 222. Each of the sidewalls includes a pair of recessed portion (e.g., recessed portions 226, 228 of sidewall 216) and each of the end walls 220, 222 includes a recessed portion 230, 232. In the illustrated embodiment, each of the recessed portions 230, 232 can be centrally located on the respective end walls 220, 222. Each of the sidewalls of the body 212 of the connecting element 210 has three spaced apertures 234 extending through the body to be selectively aligned with at least two installation holes 150 of each first and second plate 140, 142 allowing the connecting element 210 to be mounted to the first and second plates 140, 142. As shown, a spacing or distance between the adjacent apertures 234 along each sidewall is equal to the distance D1. The body 212 can further include at least two outwardly (upwardly) extending bosses 238 having openings 240 extending therethrough. The bosses 238 are dimensioned to be positioned in the installations holes 150 of at least one of the first and second plates 140, 142. In the depicted embodiment, two bosses 198 are provided along each sidewall. The body 212 can further include at least one hole 242 to reduce the weight of the connecting element 210. The bosses 238 can be separate from the body 212. The body 212 can be made from various types of elastomeric materials, foam, rubber, suitable plastics, suitable polymeric materials and/or the like.

With reference back to FIG. 8, as indicated above, at least one of the first plate 140 and second plate 142 can have at least one elongated slot 160 to be aligned with the mounting hole pattern provided on the recreational board 104. The bosses 198 of the connecting element 170 are dimensioned to be slidingly received in the elongated slot 160. Again, this allows the apertures 194 of the connecting element 170 to be selectively aligned with the mounting holes on the rider-support surface 102 of the recreational board 104.

As depicted in FIGS. 1 and 2, a plurality of separate and interchangeable dampening members 250 is connectable to riser 100 and is located at points of direct contact or engagement between the riser 100 and the rider-support surface 102 of the recreational board 104. The plurality of dampening members 250 is spaced along a portion of each first and second plate 140, 142 which is opposite the connection location of the first and second plates via the connecting element 170, 210. According to one aspect, the plurality of dampening members 250 is aligned along a length of the riser 100 so that the dampening members are located along at least one of the heel edge 130 and toe edge 132 of the recreational board 104. As shown, the plurality of dampening members 250 is provided along a length (measured parallel to longitudinal axis 118) of each first and second plate 140, 142. The plurality of dampening members 250 connected to the first plate 140 is located along the toe edge 132 of the recreational board 104 and the plurality of dampening members connected to the second plate 142 is located along the heel edge 130 of the recreational board 104. The dampening members 250 can be disk-shaped; although, this is not required.

Each of the first and second exemplary plates 140, 142 are adapted to accommodate the plurality of dampening members 250. At least one of the body 144 of the first plate 140 and the body 146 of the second plate 142 can have a plurality of spaced fingers extending outwardly therefrom, a distal end portion of each finger having one of the dampening members 250 connected thereto. In the illustrated embodiment, a plurality of spaced fingers 260, 262, 264, 266, 268 is located on the body 144 of the first plate 140. As best depicted in FIGS. 4 and 6, each of the fingers 260, 262 extends outwardly and forwardly from the body 144, and each of the fingers 266, 268 extends outwardly and rearwardly from the body 144. And finger 264 extends substantially perpendicular to the length of the body 144. The plurality of fingers 260, 262, 264, 266, 268 is defined by a plurality of spaced elongated slots 270, 272, 274, 276 located on the plate body 144. Each of the respective slots 270, 272, 274, 276 is defined by a generally curved wall 280, 282, 284, 286 which defines the angled orientation of the fingers 260, 262, 266, 268. Further, according to one aspect, fingers 266, 268 are a mirror image of fingers 260, 266 with respect to a longitudinal axis of finger 264 (which is perpendicular to axis 118 when the riser 100 is mounted to the recreational board 104). A distal end portion of each finger 260, 262, 264, 266, 268 has one of the dampening members 250 connected thereto. The plurality of fingers 260, 262, 264, 266, 268 extends a predetermined distance from the plate body 144 such that the dampening elements 250 connected to the fingers are longitudinally aligned on the first plate 140. Similarly, a plurality of spaced fingers 290, 292, 294, 296, 298 is located on the body 146 of the second plate 140. Because the fingers 290, 292, 294, 296, 298 have a configuration similar to the fingers 260, 262, 264, 266, 268, further description here is omitted for conciseness. Further, the plurality of fingers 290, 292, 294, 296, 298 extends a predetermined distance from the plate body 146 such that the dampening elements 250 connected to the distal end portions of the fingers are longitudinally aligned on the second plate 142.

Figure 11:
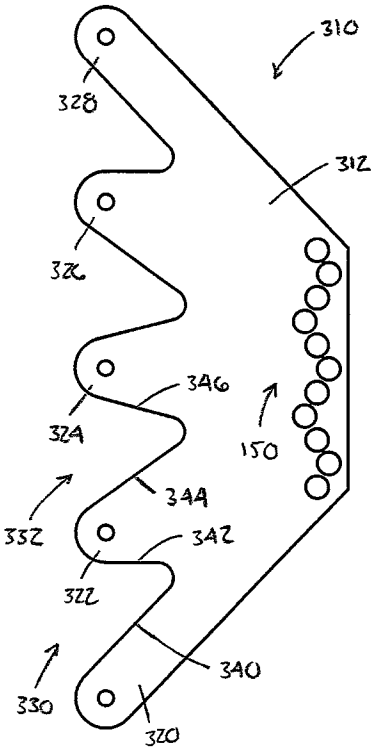
FIGS. 11-14 depict alternative configurations for the first and second plates of the riser of FIG. 2.
Figure 12:
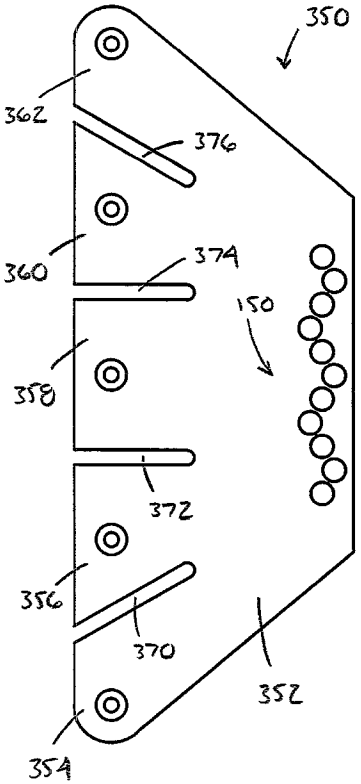
Figure 13:
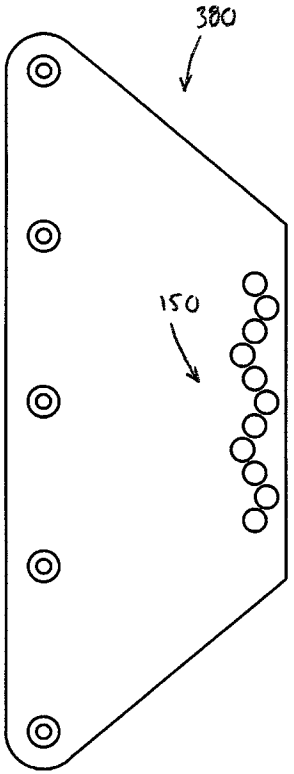
Figure 14:
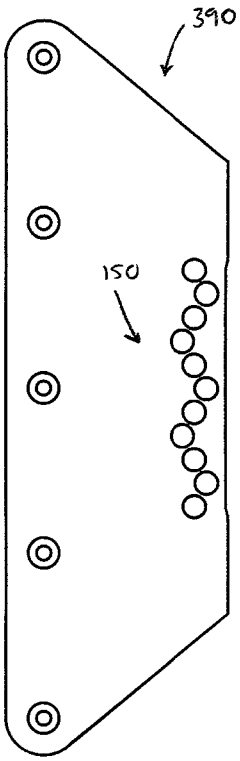

FIGS. 11-14 depict alternative configurations for the plates of the riser 100. FIG. 11 depicts a riser plate 310 having a body 312 provided with the installation holes 150. Similar to the first and second plates 140, 142 described above, a plurality of spaced fingers 320, 322, 324, 326, 328 is located on the body 312. Each of the fingers 320, 322 extends outwardly and forwardly from the body 312, and finger 324 extends substantially perpendicularly from the body 312. The fingers 320, 322, 324 are defined by elongated slots 330, 332 located on the plate body 312. In contrast to the slots of the plates 140, 142, slot 330 is defined by linear walls 340, 342 and slot 332 is defined by linear walls 344, 346. Fingers 326, 328 are a mirror image of fingers 320, 322 with respect to a longitudinal axis of finger 324 (which is perpendicular to axis 118 when the riser plate 310 is mounted to the recreational board 104). FIG. 12 also depicts a riser plate 350 having a body 352 with a plurality of fingers 354, 356, 358, 360, 362 defined by linear slots 370, 372, 374, 376. The plate 350 includes the installation holes and each finger is adapted to have one of the dampening members 250 connected thereto. FIGS. 13 and 14 depict riser plates 380, 390 having no fingers and being substantially trapezoidal shaped. Each plate 380, 390 includes the installation holes 150 and is adapted to have the plurality of dampening members 250 connected thereto and aligned along a length of the plate 380, 382.

Accordingly, it should be appreciated that various shapes for the first and second plates of the riser 100 are contemplated. However, it should be appreciated that by use of the first and second plates 140, 142 having the exemplary fingers the natural flex of the recreational board 104 is not inhibited. It should also be appreciated that the number of fingers for the first and second plates of the riser 100 can be more or less than the depicted five fingers provided on each of the first plate and second plate.

With reference back to FIGS. 2 and 3, the dampening members 250 are elastically deformable and can deform with corresponding movement of the bindings mounted atop the risers 100. In some embodiments, the riser 100 may be provided with a variety of dampening members having various thickness or various deformation characteristics (e.g. densities), such that a rider may select between dampening members having suitable characteristics for their particular riding style. Accordingly, the plurality of dampening members 250 is interchangeably selected from separate dampening members having differing hardness. For example, using the Shore A scale each dampening member 250 can have a durometer ranging from 60 A to 100 A, and can be designated as a low, medium and high durometer dampening member (see FIG. 3). A softer (i.e., low durometer) dampening member absorbs more vibration but is less responsive to rider pressure. Harder dampening members (i.e., medium durometer and high durometer) are more responsive but transmit more vibration to the rider. And dampening members 250 of various hardness can be used in any combination on the riser 100. For example, a rider may install softer dampening members along the heel edge 130 of the recreational board 104 and harder dampening members on the toe edge 132. Or, a rider may install harder dampening members on the two outermost fingers 260, 268 of the first plate 140 and the two outermost fingers 290, 298 of the second plate 142 to deliver more edge pressure and softer dampening members in the middle of each plate (i.e., on fingers 262, 264, 266 and fingers 292, 294, 296) to absorb more vibration.

Figure 9:
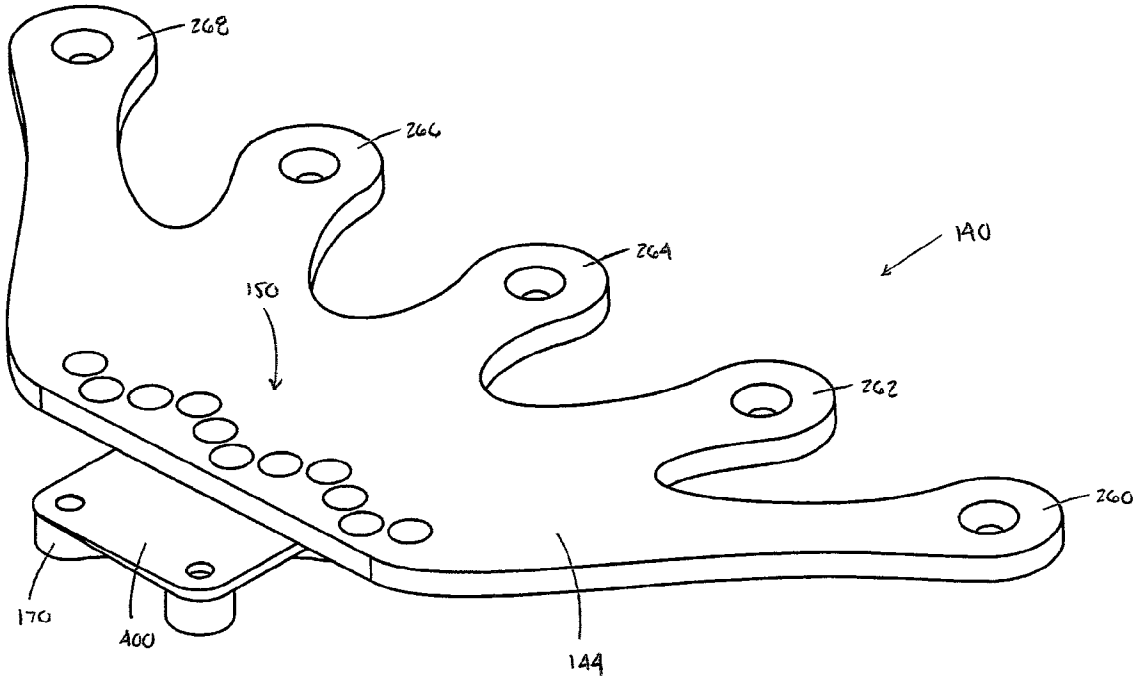
FIG. 9 is a partial perspective view of the riser of FIG. 4 including a canting member connected to the connecting element.
Figure 10:
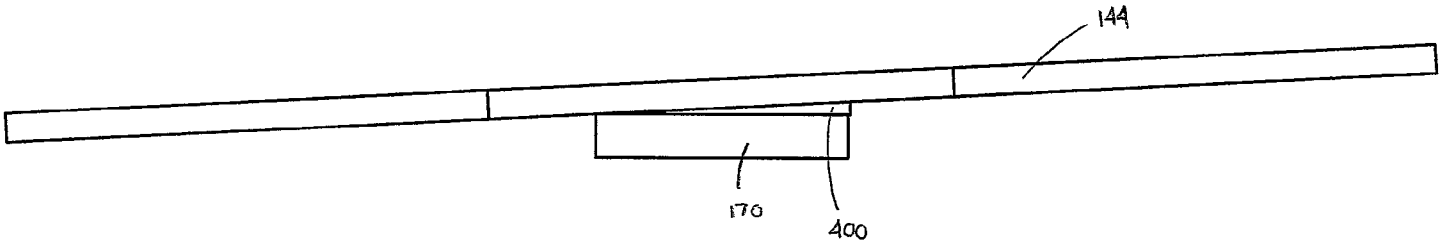
FIG. 10 is a side view of FIG. 9.

It is also contemplated that at least one of the first and second plates can be configured to be canted relative the rider-support surface 102 of the recreational board 104. According to one aspect, dampening members of varying thickness can be mounted to the first and second plates 140, 142 to allow the rider to install at least one of the plates in a canted position. For example, thicker dampening members installed on the first plate 140 would position the rider's foot in a toe-high configuration. As depicted in FIGS. 9 and 10, and according to another aspect, an optional canting wedge 400 can be installed between one of the first and second plates 140, 142 and the connector 170 to allow canting and lift. The canting wedge 400 includes apertures 402 which are aligned with the apertures 194 of the connecting element 170 so that the fasteners for securing the riser plates 140, 142 to the connecting element 170 also secure the canting wedge 400 to the connecting element 170. Still further, it is contemplated that canting can be supported by different thickness dampening member mounted between at least one of the first and second plates 140, 142 and the connecting element 170.

Each of the dampening members 250 may be adhesively bonded using a removable adhesive or otherwise removably fastened beneath the riser 100. Suitable fasteners can extend through openings 410 located on each of the fingers of the first and second plates 140, 142 and corresponding openings 412 provided on the dampening members 250. By way of example, as shown in FIG. 2, suitable fasteners can be a bolt 414 which extends through the openings 410, 412 and is engaged by a nut 416 or can be a pin 418 which extends through the openings 410, 412 and is engaged by a corresponding clip 420.

The plurality of dampening members 250 may be fabricated from any suitable resilient material which may be deformed (e.g. compressed) under the forces associated with the movement of the bindings and which tends to elastically restore itself (e.g. to expand) to its original shape and size when such forces are removed or reduced. Suitable materials for the dampening members include various types of elastomeric materials, foam, rubber, suitable plastics, suitable polymeric materials and/or the like.

As is evident from the forgoing, it should be appreciated that by using a different combination of installation holes, the riser 100 can be made to fit recreational boards of different widths. Each of the first and second plates 140, 142 can be independently positioned. This allows the rider to install the plates in an asymmetrical layout. For example, the rider may prefer the toe side plate to be more forward of the heel side plate. According to one aspect, the connecting element 170, 210 is separate from the first and second plates and can be secured to the plates by any mechanical means known in the art. According to another aspect, the connecting element can be part of one of the first and second plates. The connecting element allows for movement in two directions of one plate relative to the other plate and also allows the plates to be connectable an offset matter.

It should also be appreciated that the exemplary riser 100 delivers the benefit of boot elevation but adds additional, performance enhancing benefits. With the user of the dampening members 250, vibration that occurs when the recreational board 104 is ridden over hard, uneven surfaces is absorbed. This vibration is absorbed by the individual dampening members 250 and also by the spring like effect of the fingers provided on the first and second plates 140, 142. Pressure from the rider's foot is delivered to a wider area on the recreational board 104 and is concentrated along the heel and toe edges 130, 132 of the recreational board 104 through the dampening members 250. The exemplary riser 100 also allows variations in installation that are user adjustable.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A riser for mounting to a rider-support surface of a recreational board and having a binding connected thereto, the riser comprising:

a first plate and a second plate selectively positionable relative to the first plate along a length direction of the riser; and a plurality of separate and interchangeable dampening members directly connectable to each of the first plate and second plate, the plurality of dampening members being spaced along a portion of each first and second plate which is opposite a connection location of the riser, the plurality of dampening members including a first dampening member and a second dampening member, each having a differing hardness, wherein at least one of the first and second plates includes a body having spaced protrusions extending outwardly therefrom in a width direction of the riser, a distal end portion of each protrusion having one of the dampening members directly connected thereto.

2. The riser of claim 1, wherein at least one of the first plate and second plate includes installation holes defining at least one installation hole pattern corresponding to a mounting hole pattern provided on the rider-support surface of the recreational board, and the installation holes further allowing for an adjustable spacing between the first and second plates.

3. The riser of claim 2, further including a separate connecting element mounting the riser to the rider-support surface of the recreational board.

4. The riser of claim 3, wherein the connecting element includes at least two bosses dimensioned to be positioned in the installations holes.

5. The riser of claim 3, wherein at least one of the first plate and second plate has an elongated slot to be aligned with a mounting hole pattern provided on the recreational board, and the connecting element includes at least two bosses dimensioned to be slidingly received in the elongated slot.

6. The riser of claim 3, wherein each of the first and second plates is adapted to be independently positioned on the rider-support surface of the recreational board allowing for installation of the first and second plates in an asymmetrical layout, the connecting element being configured to allow for movement in two directions of the first plate relative to the second plate and allowing the first and second plates to be connectable in an offset matter.

7. The riser of claim 1, where each of the first plate and the second plate is formed of a composite material, the composite material being a carbon fiber material.

8. The riser of claim 1, wherein at least one of the first and second plates is configured to be canted relative the rider-support surface of the recreational board.

9. The riser of claim 1, wherein the plurality of dampening members connectable to the first plate are locatable along a toe edge of the recreational board and the plurality of dampening members connectable to the second plate are locatable along a heel edge of the recreational board.

10. The riser of claim 1, wherein each of the plurality of dampening members is disk-shaped and has a durometer ranging from 60 A to 100 A.

11. The riser of claim 1, wherein the protrusions are defined by spaced elongated slots located on the plate body.

12. The riser of claim 1, wherein each of the first and second plates includes a body having spaced protrusions extending outwardly therefrom, a distal end portion of each protrusion having one of the dampening members directly connected thereto.

13. The riser of claim 1, wherein each of the protrusions extends a predetermined distance from the plate body such that the dampening elements connected to the protrusions are longitudinally aligned on the at least one plate.

14. A riser for mounting to a rider-support surface of a recreational board and having a binding connected thereto, the riser comprising:

a first plate and a separate second plate selectively positionable along a length of the first plate, at least one of the first and second plates includes a plurality of installation holes defining at least two installation patterns which are offset inwardly from one another relative to a connecting edge of the one plate, each installation pattern corresponding to a mounting hole pattern provided on the rider-support surface of the recreational board;

a connecting element configured to mount the riser to the rider-support surface of the recreational board, the connecting element allowing for movement in two directions of the first plate relative to the second plate and allowing the first and second plates to be connectable in an offset matter; and a plurality of separate and interchangeable dampening members directly connectable to each of the first plate and second plate, the plurality of dampening members including a first dampening member, a second dampening member, and a third dampening member, each having a differing hardness.

15. The riser of claim 14, wherein at least one of the first and second plates includes a plurality of outwardly extending spaced fingers, a distal end portion of each finger having one of the dampening members connected thereto.

16. The riser of claim 15, wherein the plurality of dampening members is aligned along a length of the at least one plate.

17. The riser of claim 14, wherein each of the first and second plates is adapted to be independently positioned on the rider-support surface of the recreational board allowing for installation of the first and second plates in an asymmetrical layout.

* * * * *